United States Patent [19]

Münzel

[11] Patent Number: 4,895,075

[45] Date of Patent: Jan. 23, 1990

[54] METHOD OF, AND APPARATUS FOR, DETONATING A PROJECTILE IN THE PROXIMITY OF A TARGET

[75] Inventor: Klaus Münzel, Klingnau, Switzerland

[73] Assignee: Werkzeugmaschinenfabrik Oerlikon-Bührle AG, Zürich, Switzerland

[21] Appl. No.: 247,830

[22] Filed: Sep. 22, 1988

[30] Foreign Application Priority Data

Sep. 29, 1987 [CH] Switzerland ..... 782/87

[51] Int. Cl.[4] ..... F42C 13/04; F42C 13/06

[52] U.S. Cl. ..... 102/214; 102/211

[58] Field of Search ..... 102/211, 213, 214; 342/68

[56] References Cited

U.S. PATENT DOCUMENTS

| | | | |
|---|---|---|---|
| 3,242,339 | 3/1966 | Lee | 102/213 |
| 3,670,652 | 6/1972 | Ziemba | 102/214 |
| 3,765,338 | 10/1973 | Dalle Mura | 102/214 |
| 3,805,103 | 11/1974 | Krupen | 102/214 |
| 3,924,234 | 12/1975 | Cash et al. | 102/214 |
| 4,021,803 | 5/1977 | Richmond et al. | 102/211 |
| 4,030,420 | 6/1977 | Skagerlund | 102/211 |
| 4,135,452 | 1/1979 | Kinsey et al. | 102/214 |
| 4,140,060 | 2/1979 | Brenner | 102/214 |
| 4,503,775 | 3/1985 | Thordarson | 102/214 |
| 4,599,616 | 7/1986 | Barbella et al. | 342/68 |
| 4,625,647 | 12/1986 | Laures | 102/211 |

FOREIGN PATENT DOCUMENTS

| | | | |
|---|---|---|---|
| 1222308 | 5/1987 | Canada | 102/211 |
| 64900 | 11/1982 | European Pat. Off. | 102/214 |
| 0161962 | 11/1985 | European Pat. Off. . | |
| 2347374 | 9/1979 | Fed. Rep. of Germany . | |
| 2527368 | 5/1982 | Fed. Rep. of Germany . | |
| 1728635 | 7/1985 | Fed. Rep. of Germany | 102/214 |
| 1594601 | 8/1981 | United Kingdom . | |

*Primary Examiner*—Deborah L. Kyle
*Assistant Examiner*—Stephen Johnson
*Attorney, Agent, or Firm*—Werner W. Kleeman

[57] ABSTRACT

Upon detonating a projectile in the proximity of a target, there are produced projectile fragments which fly towards the target in a predetermined direction. To have as many fragments as possible fly towards the target, the projectile must be detonated at a suitably selected angle measured between the line of sight which extends between the projectile and the target, and the projectile flight trajectory. This detonation angle varies as a function of the encountering velocity of the projectile and the target. A predetermined reference value associated with a predetermined encountering velocity value is computed using a stationary firing control system and represented by the quotient c/(2VBg), wherein c is the velocity of light and VBg is the predetermined encountering velocity value. Such reference value is stored in a storage device aboard the projectile. The projectile also contains a device for determining a plurality of encountering velocity values and such device converts the determined encountering velocity values into actual values c/(2VB), wherein c is the velocity of light and VB the measured encountering velocity value. A comparator is connected with the determining device and storage device and compares the actual values and the reference value. Detonation of the projectile occurs once the actual value is substantially equal to or exceeds the stored reference value.

14 Claims, 2 Drawing Sheets

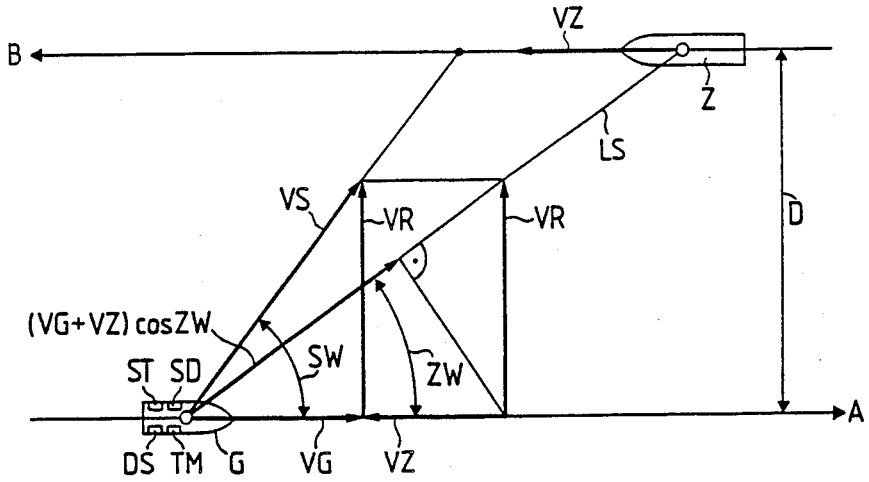
FIG. 1.
FIG. 2.
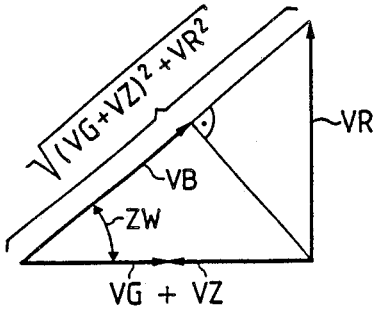
FIG. 3.
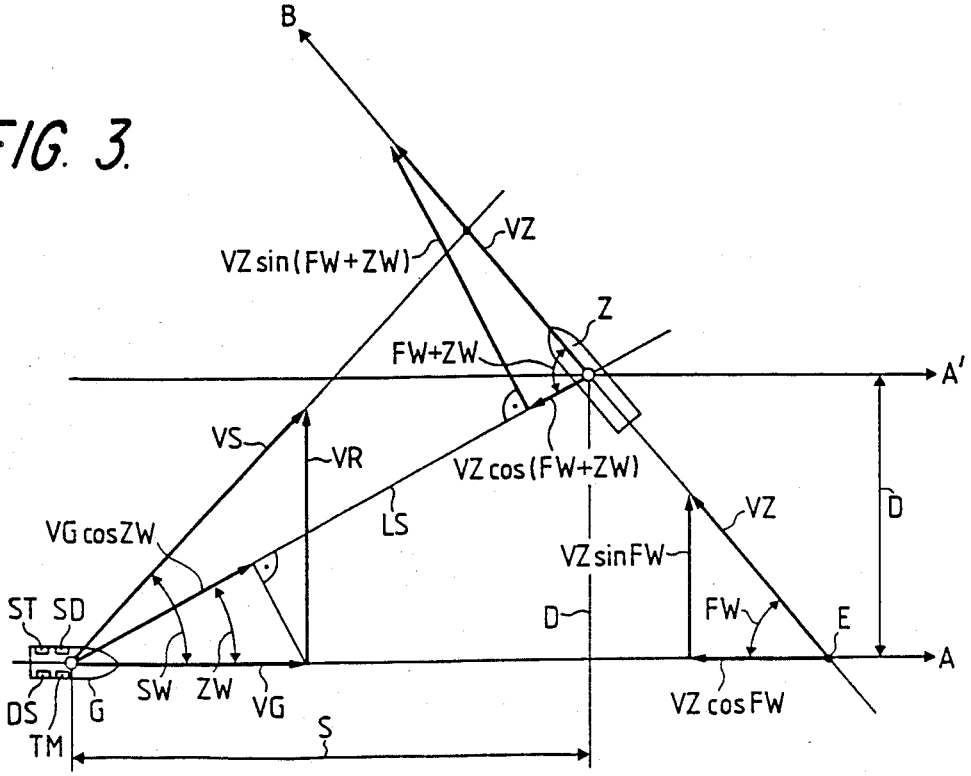

FIG. 4.
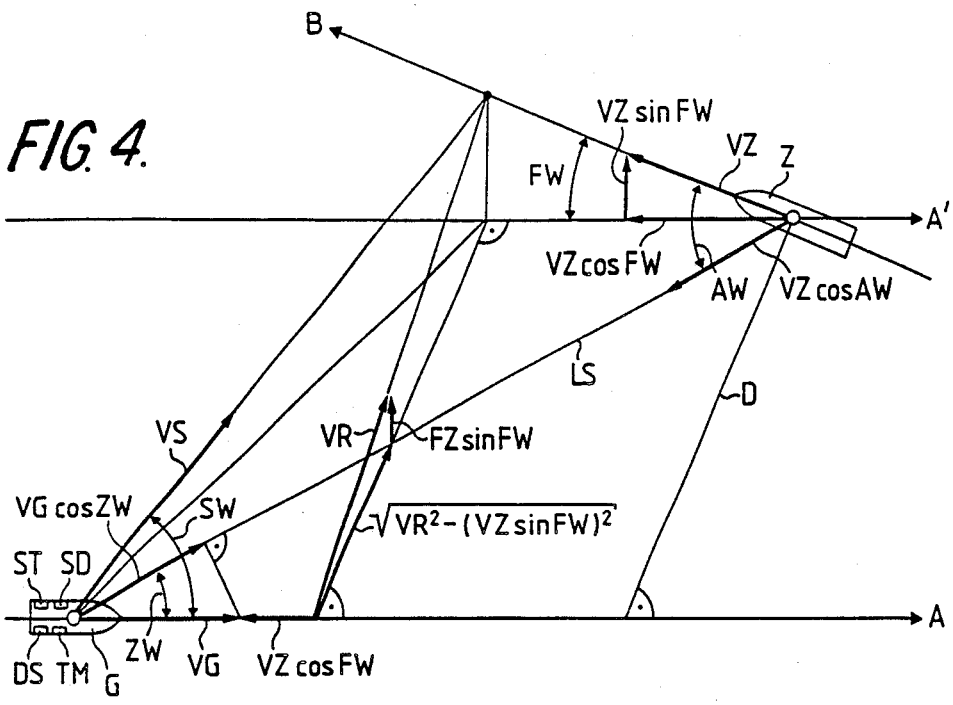
FIG. 5.
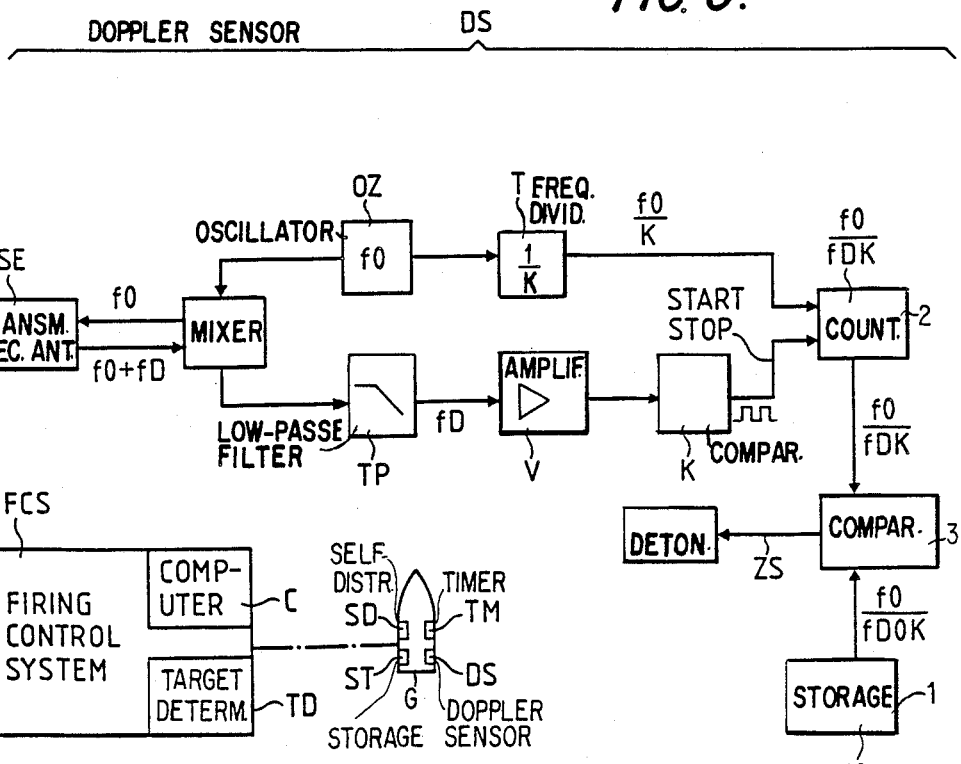
FIG. 6.

METHOD OF, AND APPARATUS FOR, DETONATING A PROJECTILE IN THE PROXIMITY OF A TARGET

BACKGROUND OF THE INVENTION

The present invention relates to a new and improved method of, and apparatus for, detonating a projectile in the proximity or vicinity of a target.

In its more particular aspects, the present invention specifically relates to a new and improved method of, and apparatus for, detonating a projectile in the proximity or vicinity of a target and which method and apparatus employ sensor means located in the projectile for determining a plurality of encountering velocity values of the projectile and the target.

In a proximity detonator, such as known, for example, from German Patent No. 2,527,368, granted May 13, 1982, the detonation angle of a proximity switch is adjusted or selected as a function of the encountering velocity between the projectile and the target at a sensor installation of the projectile. Such selection takes account of the main direction of action associated with the projectile fragments.

It is one disadvantage of this known construction that, in addition to the aforementioned sensor means for determining the plurality of encountering velocity values, the sensor for effecting the detonation at a desired detonation angle must be incorporated into the projectile.

Sensors for use with proximity detonators and for response at a predetermined detonation angle are known, for example, from U.S. Pat. No. 3,046,892, granted July 31, 1962, and U.S. Pat. No. 3,242,339, granted Mar. 22, 1966.

It is one disadvantage of such known sensors that these sensors are independent of the encountering velocity of the projectile and the target. In most cases, the sensors are adjusted for a fixed detonation angle. As a result, the fragments of the projectile may fly past the target without producing a target hit.

SUMMARY OF THE INVENTION

Therefore, with the foregoing in mind it is a primary object of the present invention to provide a new and improved method of, and apparatus for, detonating a projectile in the proximity or vicinity of a target and which method and apparatus are not afflicted with the drawbacks and limitations of the prior art heretofore discussed.

It is a further important object of the present invention to provide a new and improved method of, and apparatus for, detonating a projectile in the proximity or vicinity of a target and which method and apparatus permit detonating the projectile precisely at a predetermined or desired detonation angle.

Another significant object of the present invention is directed to a new and improved method of, and apparatus for, detonating a projectile in the proximity or vicinity of a target and which method and apparatus permit relatively precise determination of the encountering velocity of the projectile and the target in a manner which takes due account of at least most of the factors which affect the encountering velocity.

It is a still further notable object of the present invention to provide a new and improved method of, and apparatus for, detonating a projectile in the proximity or vicinity of a target and which method and apparatus can be operated without directly determining or accounting for the target offset from the projectile.

Now in order to implement these and still further objects of the invention, which will become more readily apparent as the description proceeds, the apparatus of the present development is manifested by the features that, among other things, a firing control system determines the predetermined encountering velocity of the projectile and the target upon projectile firing such that the target is hit by the fragments are produced upon detonation of the projectile. Storage or memory means are provided in the projectile and there is stored therein a reference value which is associated with the predetermined encountering velocity value of the projectile and the target. This reference value is represented by the quotient c/(2VBg), wherein c represents the velocity of light and VBg the predetermined encountering velocity value. The sensor means for determining the plurality of encountering velocity values and which sensor means are located in the projectile, convert the determined encountering velocity values into actual values c/(2VB), wherein c is the velocity of light and VB the determined encountering velocity value. Comparator means are provided for comparing the actual values and the stored reference value. The comparator means generate a detonation signal and thus effect detonation of the projectile once the actual value selectively is either (i) substantially equal to or (ii) greater than such stored reference value.

According to a preferred embodiment of the inventive apparatus, the sensor means for determining the plurality of encountering velocity values contain a Doppler sensor. Such Doppler sensor contains an oscillator operating at a predetermined frequency, a transmitting and receiving antenna for transmitting radiation of the predetermined frequency and receiving target reflected radiation of said predetermined frequency which is modulated by the Doppler frequency and, a frequency divider having a predetermined division factor and connected to the aforementioned oscillator. The Doppler sensor further contains a counter for forming the actual values which are associated with the plurality of encountering velocity values in the form (f0)/(fDK), wherein f0 represents the predetermined frequency of the oscillator, fD the Doppler frequency associated with a respective one of the plurality of encountering velocity values, and K the division factor. The storage means, in this embodiment, have stored therein the reference value which is associated with the predetermined encountering velocity value, in the form (f0)/(fD0K), wherein f0 represents the predetermined frequency of the oscillator, fD0 a predetermined Doppler frequency associated with the predetermined encountering velocity value, and K the aforementioned division factor. The comparator means produce the detonation or detonating signal for detonating the projectile whenever the computed actual values associated with the plurality of encountering velocity values selectively are either (i) substantially equal to or (ii) smaller than the stored reference value associated with the predetermined encountering velocity value.

In an advantageous further development of the inventive apparatus, timing means are operatively connected to the sensor means for determining the plurality of the encountering velocity values. The timing means are set for activating such sensor means at a present time interval after firing of the projectile. Such preset time interval is determined on the basis of the projectile flight time until collision with the target and a lead time. Thus, the sensor means which, for example, may constitute a Doppler sensor, are only operated when the projectile has come sufficiently close to the target. This has the beneficial effect that the detonator and more specifically, the sensor means are made insensitive to electromagnetic interferences.

As alluded to above, the invention is not only concerned with the aforementioned apparatus aspects, but also relates to a novel method of detonating a projectile in the proximity of a target.

In order to achieve the aforementioned measures, the inventive method, in its more specific aspects, comprises the following steps:

determining a target flight trajectory of a target;

firing a projectile towards the target along a predetermined projectile flight trajectory under the control of a firing control system;

determining, in the projectile and during movement of the projectile along the predetermined projectile flight trajectory, a plurality of encountering velocity values of the projectile and the target;

upon firing of the projectile, storing therein a reference or set value associated with a predetermined encountering velocity value;

converting the plurality of encountering velocity values into a plurality of actual values associated with the plurality of encountering velocity values;

comparing the plurality of actual values with the stored reference or set value; and detonating and thereby fragmenting the projectile at a predetermined result of the comparison between the plurality of actual values, which are associated with the plurality of encountering velocity values, and the stored reference value which is associated with the predetermined encountering velocity value.

In a preferred embodiment of the invention method, a Doppler sensor is used for determining the plurality of encountering velocity values and converting the same into the actual values. During such determining operation, the Doppler sensor is operated at a predetermined frequency, the frequency is divided by a predetermined division factor and the target associated Doppler frequency is determined. The actual values which are associated with the plurality of encountering velocity values, are determined in the form of (f0)/(fDK), wherein f0 represents the predetermined operating frequency of the Doppler sensor, fD the Doppler frequency related to a respective one of the plurality of encountering velocity values, and K the predetermined division factor.

The stored reference or set value which is associated with the predetermined encountering velocity value, has the form of (f0)/(fD0K), wherein f0 is the predetermined operating frequency of the Doppler sensor, fD0 is a predetermined Doppler frequency, and K is the predetermined division factor.

In this embodiment, the detonating and projectile fragmenting step occurs whenever the actual value associated with the respective one of the plurality of encountering velocity values, selectively is either (i) substantially equal to or (ii) smaller than the stored reference value associated with the predetermined encountering velocity value.

In a preferred embodiment of the inventive method, the Doppler sensor is activated after a preset time interval after firing of the projectile in order to render the Doppler sensor insensitive to electromagnetic interferences.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 1 is a schematic graphical illustration showing the positional relationship between the projectile and the target and at which positional relationship the detonation of the projectile is effected in an exemplary embodiment of the inventive method and apparatus, in the event of a target offset from the projectile and in the presence of substantially parallel sections in the projectile flight trajectory and the target flight trajectory;

FIG. 2 shows a vector diagram illustrating the directional relationships between the projectile velocity, the target velocity and the mean radial fragment velocity;

FIG. 3 is a schematic graphical illustration showing the positional relationship between the projectile and the target and at which positional relationship the projectile is detonated in the exemplary embodiment of the inventive apparatus, in the event of a target offset from the projectile and in the presence of a common plane which contains at least a section of the projectile flight trajectory and at least a section of the target flight trajectory;

FIG. 4 is a schematic graphical illustration showing the positional relationship between the projectile and the target and at which positional relationship the projectile is detonated in the exemplary embodiment of the inventive method and apparatus, in the event of a target offset from the projectile and in the presence of a skewed target flight trajectory relative to the projectile flight trajectory;

FIG. 5 is a schematic block circuit diagram of a Doppler sensor and related components which are located at the projectile in the exemplary embodiment of the inventive method and apparatus; and FIG. 6 is a schematic illustration showing the relationship between a, for instance, stationary firing control system and a projectile in the exemplary embodiment of the invention before firing.

DETAILED DESCRIPTION OF THE PREFERRED EMBODIMENTS

Describing now the drawings, it is to be understood that only enough of the construction of the apparatus has been shown as is needed for those skilled in the art to readily understand the underlying principles and concepts of the present development, which simplifying the showing of the drawings. Turning attention now specifically first to FIGS. 1 and 6 of the drawings, there has been schematically illustrated in FIG. 6 by way of example and not limitation, a for instance, stationary firing control system FCS in its operative association with a projectile G. The stationary firing control system FCS contains conventional means TD for determining a target flight trajectory B of a detected target Z (see for example, FIG. 1). The firing control system FCS controls the firing of the projectile G which, after firing, moves along a predetermined projectile flight trajectory A, as shown, for instance, in FIG. 1.

The stationary firing control system FCS contains a computer section C which determines, on the basis of the projectile flight trajectory A and the target flight trajectory B, a predetermined value of the encountering velocity VBg of the projectile G and the target Z. On the basis of this predetermined encountering velocity value, there is formed a reference or set value associated therewith and which is employed for detonating the projectile G such that the target Z is reliably hit by the fragments of the projectile G.

More specifically, the thus predetermined encountering velocity value is stored in storage or memory means ST which are located aboard the projectile G, preferably after conversion into a reference value in the form c/(2VBg), wherein c represents the velocity of light and VBg the predetermined encountering velocity value, when the projectile is equipped with sensor means DS, typically, for example, with a Doppler sensor of the type as will be described further hereinbelow with reference to FIG. 5. Such sensor means DS is operatively associated with the storage means ST and determines a plurality of encountering velocity values which are converted into actual values associated with such encountering velocity values and having the form c/2VB), wherein c represents the velocity of light and VB, a respective one of the plurality of encountering velocity values. The sensor means DS, particularly the Doppler sensor, is operatively connected to timing means TM which activate the sensor means DS, particularly the Doppler sensor at a preset time interval after firing of the projectile G.

The projectile G is further equipped with self-destruction means SD which are also operatively connected to the timing means TM and effect self-destruction of the projectile G after a preset time duration in the event that, during such preset time duration, the projectile G has not been detonated on the basis of a comparison between the reference or set value and the actual values.

The sensor means DS contain comparator means 3 (FIG. 5) which receive the stored reference or set value from the storage means ST and compare the actual values determined on the basis of the plurality of measured encountering velocity values. Such comparator means 3 generate a detonating signal ZS which is supplied to a detonator or detonator means DET for detonating the projectile G whenever an actual value c/(2VB) associated with a respective one of the plurality of encountering velocity values selectively is either (i) substantially equal to or (ii) exceeds the stored reference value c/(2VBg) which is associated with the predetermined value of the encountering velocity of the projectile G and the target Z.

As a matter of further explanation and with reference, for example, to FIG. 1, the fragments which are produced by detonating the projectile G, move at a fragment velocity VS towards the target Z under a predetermined fragment escape angle SW which is measured between the fragment velocity VS and the projectile flight trajectory A. The fragment escape angle SW depends upon the velocity VG of the projectile G and also upon the mean radial fragment velocity VR of the escaping fragments. Thus, as illustrated for example, in FIGS. 1 and 3, $$tg\,SW = \frac{VR}{VG} \text{ or } SW = \text{arctg}\,\frac{VR}{VG}.$$

Furthermore, for the fragments of the projectile G to hit the target Z, it is required that the projectile G is detonated at a predetermined detonation angle ZW or in a predetermined range of values of such detonation angle ZW which is formed between the projectile trajectory A and the line of sight LS which extends between the projectile G and the target Z as illustrated in FIGS. 1 through 4 of the drawings. The detonation angle ZW is interrelated with, or dependent upon, the encountering velocity of the projectile G and the target Z. Therefore, as will be further described hereinbelow with reference to FIGS. 1 through 4, the reference value which is associated with the predetermined encountering velocity value and which is stored upon firing of the projectile G in the storage means ST aboard the projectile G, is selected such as to correspond to a predetermined detonation angle ZW or a predetermined range of values of such detonation angle ZW.

With reference to the positional relationship of the projectile G and the target Z as shown in FIG. 1, there is schematically graphically illustrated, a positional target offset D. At least the illustrated section of the projectile flight trajectory A and at least the illustrated section of the target flight trajectory B are here assumed to extend substantially parallel to each other. In the illustrated positions of the projectile G and the target Z, the projectile G has proceeded on its projectile flight trajectory A to a point at which the encountering velocity VB and the detonation angle ZW have reached their predetermined value at which the projectile G is detonated.

Specifically, the encountering velocity VB and the detonation angle ZW are related to each other by the following equation:

$$VB=(VG+VZ)\cos ZW. \quad (1)$$

wherein VB is the encountering velocity, VG the projectile velocity, VZ the target velocity and ZW the detonation angle.

From the rectangular triangle illustrated in FIG. 2, there is obtained the following relationship for the cosine of the detonation angle ZW:

$$\cos ZW = \frac{VG + VZ}{\sqrt{(VG + VZ)^2 + VR^2}}, \quad (2)$$

wherein VG, VZ and ZW are defined as before and VR represents the mean radial fragment velocity of the fragments produced by detonation of the projectile G.

From these two equations, the following relationship is obtained for determining the encountering velocity VB:

$$VB = \frac{(VG + VZ)^2}{\sqrt{(VG + VZ)^2 + VR^2}}, \quad (3)$$

With respect to FIG. 3, there is shown in a schematic graphical illustration, the positional relationship between the projectile G and the target Z in the event of a target offset D and in the presence of a flight angle FW between the projectile flight trajectory A and the target flight trajectory B. In the there illustrated example, the projectile flight trajectory A and the target flight trajectory B at least contain sections which are located in a common plane. The projectile velocity VG, the target velocity VZ, the mean radial fragment velocity VR, the fragment velocity VS, the fragment escape angle SW and the detonation angle ZW are designated analogously as hereinbefore with reference to FIG. 1.

In the illustration of FIG. 3, the fragments which escape from the detonated projectile G, have a mean radial fragment velocity of VR and the target Z has a target velocity component VZ sin FW in the same direction. Therefore, the fragments travel the distance VR×t during the time t and during this time t, the target Z travels the distance VZ sin FW×t. Consequently, the flight time t of the fragments can be given as:

$$t = \frac{D}{VR - VZ \sin FW}. \tag{4}$$

During such time t, the projectile travels the distances S−VG×t and the target Z travels the distance VZ cos FW×t along the projectile flight trajectory A.

After this flight time t, the projectile G has travelled the distance S:

$$S = (VG + VZ \cos FW) \cdot \frac{D}{VR - VZ \sin FW} \tag{5}$$

Furthermore, the tangents of the detonation angle ZW at the aforementioned time t is given by:

$$tg\ ZW = \frac{D}{S} = \frac{VR - VZ \sin FW}{VG + VZ \cos FW} \tag{6}$$

There is thus obtained the result that the tangent of the detonation angle ZW is independent of the target offset D and merely dependent upon the mean radial fragment velocity VR, the projectile velocity VG and the related components of the target velocity VZ. Thus, the detonation angle ZW can be predetermined by the firing control system FCS. Furthermore, from Equation (6), there follows that the mean radial fragment velocity VR of the projectile fragments must be greater than the related component of the target velocity VZ before the projectile can be detonated.

With respect to the encountering velocity VB of the projectile G and the target Z, there exists the relationship:

$$VB = VG \cos ZW + VZ \cos (FW + ZW) \tag{7}$$

From the following further equation for the encountering velocity VB:

$$VB = \cos ZW (VG + VZ \cos FW) - VZ \sin FW\ tg\ ZW, \tag{8}$$

there is obtained the final equation for the encountering velocity VB:

$$VB = \frac{(VG - VZ \cos FW)^2 - VZ \sin FW (VR - VZ \sin FW)}{\sqrt{(VG - VZ \cos FW)^2 + (VR - VZ \sin FW)^2}} \tag{9}$$

Regarding FIG. 4, there is shown in a schematic graphical illustration, the positional interrelationship between the projectile G and the target Z in the presence of a plane which is intersected by the target flight trajectory B and extends substantially parallel to a plane containing the projectile flight trajectory A. In this condition, the flight time of the fragments is defined by the relationship:

$$t = \frac{D}{\sqrt{VR^2 - (VZ \sin FW)^2}}, \tag{10}$$

wherein

D is the target offset from the projectile G,

VR is the mean radial fragment velocity of the fragments produced by detonating the projectile G, VZ is the target velocity, and FW the flight angle between the target flight trajectory B and the plane A′ which extends substantially parallel to the plane containing the projectile flight trajectory A.

The detonation angle ZW which is formed between the line of sight LS and the projectile flight trajectory A, obeys the following relationship:

$$tg\ ZW = \frac{D}{VG - VZ \cos FW}. \tag{11}$$

$$\frac{1}{t} = \frac{\sqrt{VR^2 - (VZ \sin FW)^2}}{VG + VZ \cos FW}$$

wherein D, VZ, FW and t are defined as hereinbefore and VG is the projectile velocity.

The encountering velocity under these conditions is given by the following relationship:

$$VB = VG \cos ZW + VZ \cos AW \tag{12}$$

wherein VG, ZW and VZ are defined as hereinbefore and VB is the encountering velocity and AW the angle formed between the line of sight LS and the target flight trajectory B at the intersection point of target flight trajectory B and the associated plane A′. On the basis of cosine law, there is obtained the following Equation for the angle AW:

$$\cos AW = \frac{VG \cos FW - VZ \sin^2 FW}{\sqrt{t^2 (VG + VZ \cos FW)^2 + D^2}} \cdot t \tag{13}$$

with the definitions as given hereinbefore.

After elimination of t from Equation (13) on the basis of Equation (11), there is obtained:

$$\cos AW = \frac{VG \cos FW - VZ \sin^2 FW}{\sqrt{(VG - VZ \cos FW)^2 + VR^2 - (VZ \sin FW)^2}} \tag{14}$$

with the definitions as given hereinbefore.

Consequently, the result of Equation 14 can be entered into Equation 12 for the encountering velocity VB and there is thus obtained, like in the previous case, an equation for the encountering velocity VB wherein such encountering velocity VB is definitely related to the detonation angle ZW formed between the line of sight LS and the projectile flight trajectory A and the flight angle FW formed between the target flight trajectory B and the intersection point thereof with the plane A′ which extends substantially parallel to the plane containing the projectile flight trajectory A.

As heretofore explained, the sensor means DS for determining the approach of the projectile G to the target Z and which sensor means DS is located in the projectile G, preferably is constructed as a Doppler sensor DS and such Doppler sensor DS and its associated components are illustrated as a block circuit diagram in FIG. 5 of the drawings. The Doppler sensor contains an oscillator OZ which operates at a predetermined frequency f0 which may be in the radar frequency range. The radiation of the predetermined oscillator frequency f0 is transmitted by means of a transmitting and receiving antenna SE. Target-reflected signals which are received by the transmitting and receiving antenna SE, contain the predetermined oscillator frequency f0 modulated by the Doppler frequency fD which is dependent upon the encountering velocity VB of the projectile G and the target Z. The received signals pass through a mixer M and a low-pass filter TP whereby the received signal having the Doppler frequency fD is produced. Such signal is amplified by means of an amplifier V which is connected to a counter 2 through a comparator K.

The counter 2 also receives, via a frequency divider T operating at a predetermined division factor K, a signal having the frequency f0/K. During operation of the Doppler sensor, the counter 2 thus produces a plurality of actual values in the form of f0/fDK which are associated with a plurality of encountering velocity values VB during the approach of the projectile G to the target Z.

Further provided are comparator means 3 here comprising a digital comparator which is connected to the counter 2 and to storage or memory means 1 which represent the storage means ST in the projectile G.

The storage means ST contain a reference value which is associated with a predetermined encountering velocity value which is computed by the firing control system FCS on the basis of the projectile flight trajectory A and the target flight trajectory B using the Equations (3), (9) or (12) and (14) in accordance with FIGS. 1, 3 or 4, as the case may be. Such reference value is stored in the storage means ST upon firing of the projectile G, as already explained hereinbefore.

The comparator means 3, for example, continuously compare the actual values f0/fDK which are fed to the comparator means 3 from the counter 2, with the reference value f0/fD0K which is fed to the comparator means 3 from the storage means ST. Whenever an actual value originating from the counter 2 which selectively is either (i) substantially equal to or (ii) smaller than the reference value, the comparator means 3 generate a detonation signal ZS which is applied to the detonator DET for detonating the projectile G.

A modification is based on the relationship $$\frac{c}{2VB} = \frac{f0}{fD} \tag{15}$$

wherein c is the velocity of light, VB the encountering velocity between the projectile G and the target Z, f0 is the predetermined oscillator frequency of the Doppler sensor, and fD is the Doppler frequency.

Accordingly, the actual values which are fed to the comparator means 3 can have the form c/2VB, as already explained hereinbefore, and the reference value fed to the comparator means 3 and stored in the storage means ST can have the form c/2VBg, as already explained hereinbefore. In such case, the detonation signal ZS is generated by the comparator means 3 whenever the actual value selectively is either (i) substantially equal to or (ii) greater than the reference value.

The timing means TM aboard the projectile G are operatively connected to the sensor means DS, particularly the Doppler sensor and is provided for serving two specific purposes. Firstly, the timing means TM ensure that the sensor means DS is activated only after a preset time interval after firing the projectile G in order to ensure that the sensor means DS is operated substantially in the absence of any electromagnetic interferences and at relatively close approach to the target Z. Secondly, the timing means TM generate an independent detonating signal ZS after a predetermined time duration following firing of the projectile G in the event that the comparator means 3 do not generate the detonation signal ZS within the predetermined time duration. The timing means TM are set upon firing of the projectile G under the control of the firing control system FCS.

The operation of the counter 2, the comparator means 3 and the storage means ST on the basis of frequency values rather than velocity values, has the advantage that the detonation signal ZS is generated by the comparator means 3 independent of any statistical variations in the predetermined oscillator frequency f0.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for detonating a projectile in the proximity of a target, comprising:

sensor means for determining a plurality of encountering velocity values of the projectile relative to the target;

said sensor means for determining said plurality of encountering velocity values being located in said projectile;

said projectile containing detonating means for producing fragments upon detonation of said projectile at a predetermined one of said plurality of encountering velocity values of said projectile relative to said target and at which predetermined encountering velocity value said target is hit by said fragments;

a firing control system;

said firing control system controlling the firing of said projectile and containing means for computing a reference value associated with said predetermined encountering velocity value;

said sensor means for determining said plurality of encountering velocity values being located in said projectile and containing means for determining actual values derived from respective ones of said plurality of encountering velocity values;

storage means operatively connected with said means for determining said actual values derived from respective ones said plurality of encountering velocity values;

said storage means storing, upon firing of said projectile, said reference value associated with said predetermined encountering velocity value;

comparator means connected with said storage means and with said means for determining said actual values derived from respective ones of said plurality of encountering velocity values;

said comparator means comprising said actual values derived from respective ones of said plurality of encountering velocity values, with said reference value stored in said storage means;

said comparator means producing a detonating signal for detonating said detonating means in response to a predetermined result of said comparison of said actual values derived from respective ones of said plurality of encountering velocity values, with said stored reference value associated with said predetermined encountering velocity value;

said means for determining said actual values derived from respective ones of said plurality of encountering velocity values, determining a plurality of actual values represented by c/2VB, wherein c is the velocity of light and VB is the encountering velocity value from which a respective one of said plurality of actual values is derived;

said storage means having stored therein as said reference value, a reference value in a form of c/2VBg, wherein c is the velocity of light and VBg is the predetermined encountering velocity value; and said comparator means producing said detonating signal whenever said predetermined result of said comparison is that the actual value derived from said respective one of said plurality of said encountering velocity values selectively is either (i) substantially equal to or (ii) greater than said stored reference value associated with said predetermined encountering velocity value.

2. An apparatus for detonating a projectile in the proximity of a target, comprising:

sensor means for determining a plurality of encountering velocity values of the projectile relative to the target which respectively move at a predetermined projectile velocity and a predetermined target velocity relative to ground;

said sensor means for determining said plurality of encountering velocity values being located in said projectile;

said projectile containing detonating means for producing fragments upon detonation of said projectile at a predetermined one of said plurality of encountering velocity values of said projectile relative to said target and at which predetermined encountering velocity value said target is hit by said fragments;

a firing control system;

said firing control system controlling the firing of said projectile and containing means for computing a reference value associated with said predetermined encountering velocity value;

said sensor means for determining said plurality of encountering velocity values being located in said projectile and containing means for determining actual values derived from respective ones of said plurality of encountering velocity values;

storage means operatively connected with said means for determining said actual values derived from respective ones of said plurality of encountering velocity values;

said storage means storing, upon firing of said projectile, said reference value associated with said predetermined encountering velocity value;

comparator means connected with said storage means and with said means for determining said actual values derived from respective ones of said plurality of encountering velocity values;

said comparator means comparing said actual values derived from respective ones of said plurality of encountering velocity values, with said reference value stored in said storage means;

said comparator means producing a detonating signal for detonating said detonating means in response to a predetermined result of said comparison of said actual values derived from respective ones of said plurality of encountering velocity values, with said stored reference value associated with said predetermined encountering velocity value;

said projectile, after firing, being associated with a predetermined projectile flight trajectory;

said target being associated with a target flight trajectory which is determined by said firing control system;

means contained in said firing control system for determining, in case of a target offset from said projectile and in presence of, in said target flight trajectory, at least a section which extends substantially parallel to at least a section of said projectile flight trajectory, a line of sight between said projectile and said target in at least said substantially parallel sections of said target flight trajectory and said projectile flight trajectory;

said line of sight, during travel of the projectile, forming a plurality of detonation angles with said projectile flight trajectory; and said means for computing said reference value associated with said predetermined encountering velocity value, computing said reference value at a predetermined one of said plurality of said detonation angles obeying the relationship $$\cos ZW = \frac{VB}{VG + VZ},$$

wherein:

ZW is the detonation angle,

VB is the associated encountering velocity value,

VG is the predetermined projectile velocity relative to ground, and

VZ is the predetermined target velocity relative to ground.

3. An apparatus for detonating a projectile in the proximity of a target, comprising:

sensor means for determining a plurality of encountering velocity values of the projectile relative to the target which respectively move at a predetermined projectile velocity and a predetermined target velocity relative to ground;

said sensor means for determining said plurality of encountering velocity values being located in said projectile;

said projectile containing detonating means for producing fragments upon detonation of said projectile at a predetermined one of said plurality of encountering velocity values of said projectile relative to said target and at which predetermined encountering velocity value said target is hit by said fragments;

a firing control system;

said firing control system controlling the firing of said projectile and containing means for computing a reference value associated with said predetermined encountering velocity value;

said sensor means for determining said plurality of encountering velocity values being located in said projectile and containing means for determining actual values derived from respective ones of said plurality of encountering velocity values;

storage means operatively connected with said means for determining said actual values derived from respective ones of said plurality of encountering velocity values;

said storage means storing, upon firing of said projectile, said reference value associated with said predetermined encountering velocity value;

comparator means connected with said storage means and with said means for determining said actual values derived from respective ones of said plurality of encountering velocity values;

said comparator means comparing said actual values derived from respective ones of said plurality of encountering velocity values, with said reference value stored in said storage means;

said comparator means producing a detonating signal for detonating said detonating means in response to a predetermined result of said comparison of said actual values derived from respective ones of said plurality of encountering velocity values, with said stored reference value associated with said predetermined encountering velocity value;

said projectile, after firing, being associated with a predetermined projectile flight trajectory;

said target being associated with a target flight trajectory which is determined by said firing control system;

means contained in said firing control system for determining, in case of a target offset from said projectile and in presence of, in said target flight trajectory, at least a section which extends in a common plane with at least a section of said projectile flight trajectory, a flight angle and a line of sight;

said flight angle being formed between at least said section of said target flight trajectory and at least said section of said projectile flight trajectory in said common plane;

said line of sight, during travel of the projectile, forming a plurality of detonation angle with at least said section of said projectile flight trajectory;

said projectile, upon detonation, producing a plurality of fragments moving at a mean radial fragment velocity relative to ground; and said means for computing said reference value associated with said predetermined encountering velocity value, computing said reference value at a predetermined flight angle and at a predetermined one of said plurality of detonation angles and which angles obey the relationship $$tg\ ZW = \frac{VR - VZ \sin FW}{VG + VZ \cos FW},$$

wherein:

ZW is the detonation angle,

VR is the mean radial fragment velocity of the fragments relative to ground,

VZ is the predetermined target velocity relative to ground,

FW is the flight angle between at least the sections of the target flight trajectory and the projectile flight trajectory in said common plane, and VG is the predetermined projectile velocity relative to ground.

4. An apparatus for detonating a projectile in the proximity of a target, comprising:

sensor means for determining a plurality of encountering velocity values of the projectile relative to the target which respectively move at a predetermined projectile velocity and a predetermined target velocity relative to ground;

said sensor means for determining said plurality of encountering velocity values being located in said projectile;

said projectile containing detonating means for producing fragments upon detonation of said projectile at a predetermined one of said plurality of encountering velocity values of said projectile relative to said target and at which predetermined encountering velocity value said target is hit by said fragments;

a firing control system;

said firing control system controlling the firing of said projectile and containing means for computing a reference value associated with said predetermined encountering velocity value;

said sensor means for determining said plurality of encountering velocity values being located in said projectile and containing means for determining actual values derived from respective ones of said plurality of encountering velocity values;

storage means operatively connected with said means for determining said actual values derived from respective ones of said plurality of encountering velocity values;

said storage means storing, upon firing of said projectile, said reference value associated with said predetermined encountering velocity value;

comparator means connected with said storage means and with said means for determining said actual values derived from respective ones of said plurality of encountering velocity values;

said comparator means comparing said actual values derived from respective ones of said plurality of encountering velocity values, with said reference value stored in said storage means;

said comparator means producing a detonating signal for detonating said detonating means in response to a predetermined result of said comparison of said actual values derived from respective ones of said plurality of encountering velocity values, with said stored reference value associated with said predetermined encountering velocity value;

said projectile, after firing being associated with a predetermined projectile flight trajectory;

said target being associated with a target flight trajectory which is determined by said firing control system;

means contained in said firing control system for determining, in case of a target offset from said projectile and in presence of a skewed target flight trajectory relative to said projectile flight trajectory, (i) sections of said projectile flight trajectory and said target flight trajectory, said sections being associated with respective substantially parallel planes, said planes being substantially parallel to each other, (ii) a flight angle and (iii) a line of sight;

said flight angle being formed between said section of said target flight trajectory and its associated plane;

said line of sight, during travel of the projectile, forming a plurality of detonation angles with said section of said projectile flight trajectory in its associated plane which extends substantially parallel to the plane associated with said section of said target flight trajectory;

said projectile, upon detonation, producing a plurality of fragments moving at a mean radial fragment velocity relative to ground; and said means for computing said reference value associated with said predetermined encountering velocity value, computing said reference value at a predetermined flight angle and at a predetermined one of said plurality of detonation angles obeying the relationship $$tg\ ZW = \frac{\sqrt{VR^2 - (VZ \sin FW)^2}}{VG + VZ \cos FW}$$

wherein:

ZW is the detonation angle,

VR is the mean radial fragment velocity of the fragments relative to ground,

VZ is the predetermined target velocity,

FW is the flight angle formed between said section of said target flight trajectory and its associated plane which is substantially parallel to the plane associated with said section of said projectile flight trajectory, and VG is the predetermined projectile velocity relative to ground.

5. An apparatus for detonating a projectile in the proximity of a target, comprising:

sensor means for determining a plurality of encountering velocity values of the projectile relative to the target;

said sensor means for determining said plurality of encountering velocity values being located in said projectile;

said projectile containing detonating means for producing fragments upon detonation of said projectile at a predetermined one of said plurality of encountering velocity values of said projectile relative to said target and at which predetermined encountering velocity value said target is hit by said fragments;

a firing control system;

said firing control system controlling the firing of said projectile and containing means for computing a reference value associated with said predetermined encountering velocity value;

said sensor means for determining said plurality of encountering velocity values being located in said projectile and containing means for determining actual values derived from respective ones of said plurality of encountering velocity values;

storage means operatively connected with said means for determining said actual values derived from respective ones of said plurality of encountering velocity values;

said storage means storing, upon firing of said projectile, said reference value associated with said predetermined encountering velocity value;

comparator means connected with said storage means and with said means for determining said actual values derived from respective ones of said plurality of encountering velocity values;

said comparator means comparing said actual values derived from respective ones of said plurality of encountering velocity values, with said reference value stored in said storage means;

said comparator means producing a detonating signal for detonating said detonating means in response to a predetermined result of said comparison of said actual values derived from respective ones of said plurality of encountering velocity values, with said stored reference value associated with said predetermined encountering velocity value;

said sensor means for determining said plurality of encountering velocity values contain a Doppler sensor;

said Doppler sensor containing an oscillator operating at a predetermined frequency, a transmitting and receiving antenna for transmitting radiation of said predetermined frequency and receiving radiation of said predetermined frequency modulated by the Doppler frequency, and a frequency divider having a predetermined division factor and connected to said oscillator;

said Doppler sensor further containing a counter constituting said means for determining said actual values derived from respective ones of said plurality of encountering velocity values, in a form of f0/fDK, wherein f0 represents said predetermined oscillator frequency, fD said Doppler frequency, and K said predetermined division factor;

said storage means having stored therein said reference value associated with said predetermined encountering velocity value in a form of f0/fD0K, wherein f0 represents said predetermined oscillator frequency, fD0 a predetermined Doppler frequency, and K said predetermined division factor; and said comparator means producing said detonating signal for detonating said projectile whenever said predetermined result of said comparison is that the actual value derived from said respective one of said plurality of encountering velocity values selectively is either (i) substantially equal to or (ii) smaller than said stored reference value associated with said predetermined encountering velocity value.

6. The apparatus as defined in claim 5, further including:

timing means operatively connected to said sensor means; and said timing means being set by means of said firing control system for activating said sensor means at a preset time interval after firing of said projectile.

7. An apparatus for detonating a projectile in the proximity of a target, comprising:

sensor means for determining a plurality of encountering velocity values of the projectile relative to the target;

said sensor means for determining said plurality of encountering velocity values being located in said projectile;

said projectile containing detonating means for producing fragments at a predetermined one of said plurality of encountering velocity values of said projectile relative to said target and at which predetermined encountering velocity value said target is hit by said fragments;

a firing control system;

said firing control system controlling the firing of said projectile and containing means for computing a reference value associated with said predetermined encountering velocity value;

said sensor means for determining said plurality of encountering velocity values being located in said projectile and containing means for determining actual values derived from respective ones of said plurality of encountering velocity values;

storage means operatively connected with said means for determining said actual values derived from respective ones of said plurality of encountering velocity values;

said storage means storing, upon firing of said projectile, said reference value associated with said predetermined encountering velocity value;

comparator means connected with said storage means and with said means for determining said actual values derived from respective ones of said plurality of encountering velocity values;

said comparator means comparing said actual values derived from respective ones of said plurality of encountering velocity values, with said reference value stored in said storage means;

said comparator means producing a detonating signal for detonating said detonating means in response to a predetermined result of said comparison of said actual values derived from respective ones of said plurality of encountering velocity values, with said stored reference value associated with said predetermined encountering velocity value;

timing means operatively connected to said sensor means;

self-destruction means;

said self-destruction means being operatively connected to said sensor means;

said timing means having preset therein by means of said firing control system a preset time duration after firing of said projectile; and said self-destruction means detonating said projectile after said preset time duration whenever said predetermined result of said comparison has not been obtained within said preset time duration.

8. A method of detonating a projectile in the proximity of a target, comprising the steps of:

determining a target flight trajectory of a target;

firing a projectile towards said target along a predetermined projectile flight trajectory under control of a firing control system;

determining, in said projectile and during movement of said projectile along said predetermined projectile flight trajectory, a plurality of encountering velocity values of the projectile relative to the target;

upon firing of said projectile, storing therein a reference value associated with a predetermined encountering velocity value of the projectile relative to the target;

converting said plurality of encountering velocity values into a plurality of actual values associated with respective ones of said plurality of encountering velocity values;

comparing said actual values associated with respective ones of said plurality of encountering velocity values, with said stored reference value associated with said predetermined encountering velocity value;

detonating and thereby fragmenting said projectile at a predetermined result of said comparison of said actual values which are associated with respective ones of said plurality of encountering velocity values, with said stored reference value which is associated with said predetermined encountering velocity value;

said step of converting said plurality of encountering velocity values into said plurality of actual values associated with respective ones of said plurality of encountering velocity values, entails converting each determined encountering velocity value into an actual value of a form c/2VB, wherein c is the velocity of light and VB the encountering velocity value with which a respective one of said plurality of actual values is associated;

said step of storing said reference value associated with said predetermined encountering velocity value entails storing said reference value in a form of c/2VBg, wherein c is the velocity of light and VBg the predetermined encountering velocity value; and said step of detonating and thereby fragmenting said projectile entails detonating and thereby fragmenting said projectile whenever said actual value associated with a respective one of said plurality of encountering velocity values selectively is either (i) substantially equal to or (ii) greater than said stored reference value associated with said predetermined encountering velocity value.

9. A method of detonating a projectile in the proximity of a target, comprising the steps of:

determining a target flight trajectory of a target moving at a predetermined target velocity relative to ground;

firing a projectile towards said target at a predetermined projectile velocity relative to ground along a predetermined projectile flight trajectory under control of a firing control system;

determining, in said projectile and during movement of said projectile along said predetermined projectile flight trajectory, a plurality of encountering velocity values of the projectile relative to the target;

upon firing of said projectile, storing therein a reference value associated with a predetermined encountering velocity value of the projectile relative to the target;

converting said plurality of encountering velocity values into a plurality of actual values associated with respective ones of said plurality of encountering velocity values;

comparing said actual values associated with respective ones of said plurality of encountering velocity values, with said stored reference value associated with said predetermined encountering velocity values;

detonating and thereby fragmenting said projectile at a predetermined result of said comparison of said acutal values which are associated with respective ones of said plurality of encountering velocity values, with said stored reference value which is associated with said predetermined encountering velocity value;

in case of a target offset from said projectile, determining at least substantially parallel sections of said projectile flight trajectory and said target flight trajectory, and a line of sight;

said line of sight being determined between said projectile and said target and, during travel of the projectile, forming a plurality of detonation angles with at least said section of said projectile flight trajectory;

said step of storing said reference value associated with said predetermined encountering velocity value, includes storing a reference value which is associated with a predetermined one of said plurality of detonation angles; and said detonation angle obeying the relationship $$\cos ZW = \frac{VB}{VG + VZ},$$

wherein:

ZW is the detonation angle,

VB is the associated encountering velocity value,

VG is the predetermined projectile velocity relative to ground, and

VZ is the predetermined target velocity relative to ground.

10. A method of detonating a projectile in the proximity of a target, comprising the steps of:

determining a target flight trajectory of a target moving at a predetermined target velocity relative to ground;

firing a projectile towards said target at a predetermined projectile velocity relative to ground along a predetermined projectile flight trajectory under control of a firing control system;

determining, in said projectile and during movement of said projectile along said predetermined projectile flight trajectory, a plurality of encountering velocity values of the projectile relative to the target;

upon firing of said projectile, storing therein a reference value associated with a predetermined encountering velocity value of the projectile relative to the target;

converting said plurality of encountering velocity values into a plurality of actual values associated with respective ones of said plurality of encountering velocity values;

comparing said actual values associated with respective ones of said plurality of encountering velocity values, with said stored reference value associated with said predetermined encountering velocity value;

detonating and thereby fragmenting said projectile at a predetermined result of said comparison of said actual values which are associated with respective ones of said plurality of encountering velocity values, with said stored reference value which is associated with said predetermined encountering velocity value;

in case of a target offset from said projectile, determining (i) at least sections of said projectile flight trajectory and said target flight trajectory and which sections extend in a common plane, (ii) a flight angle and (iii) a line of sight;

said flight angle being determined between at least said section of said target flight trajectory and at least said section of said projectile flight trajectory in said common plane;

said line of sight being determined between said projectile and said target and, during travel of the projectile, forming a plurality of detonation angles with at least said section of said projectile flight trajectory;

said step of storing said reference value associated with said predetermined encountering velocity value, includes storing a reference value which is also associated with a predetermined flight angle and a predetermined one of said plurality of detonation angles;

detonating said projectile at said predetermined detonation angle and thereby producing a plurality of fragments moving at a mean radial fragment velocity relative to ground; and said detonation angle obeying the relationship $$tg\, ZW = \frac{VR - VZ \sin FW}{VG + VZ \cos FW},$$

wherein:

ZW is the detonation angle,

VR is the mean radial fragment velocity of the fragments relative to ground,

VZ is the predetermined target velocity relative to ground,

FW is the flight angle formed between at least said sections of said target flight trajectory and said section of said projectile flight trajectory in said common plane, and VG is the predetermined projectile velocity relative to ground.

11. A method of detonating a projectile in the proximity of a target, comprising the steps of:

determining a target flight trajectory of a target moving at a predetermined target velocity relative to ground;

firing a projectile towards said target at a predetermined projectile velocity relative to ground along a predetermined projectile flight trajectory under control of a firing control system;

determining, in said projectile and during movement of said projectile along said predetermined projectile flight trajectory, a plurality of encountering velocity values of the projectile relative to the target;

upon firing of said projectile, storing therein a reference value associated with a predetermined encountering velocity value of the projectile relative to the target;

converting said plurality of encountering velocity values into a plurality of actual values associated with respective ones of said plurality of encountering velocity values;

comparing said actual values associated with respective ones of said plurality of encountering velocity values, with said stored reference value associated with said predetermined encountering velocity value;

detonating and thereby fragmenting said projectile at a predetermined result of said comparison of said actual values which are associated with respective ones of said plurality of encountering velocity values, with said stored reference value which is associated with said predetermined encountering velocity value;

in case of a target offset from said projectile and in the presence of a skewed target flight trajectory relative to said projectile flight trajectory, determining (i) at least sections of said projectile flight trajectory and said target flight trajectory, said sections extending in substantially parallel planes, said planes being substantially parallel to each other, (ii) a flight angle and (iii) a line of sight;

said flight angle being determined between at least said section of said target flight trajectory and its associated plane;

said line of sight being determined between said projectile and said target and, during travel of the projectile, forming a plurality of detonation angles with at least said section of said projectile flight trajectory;

said step of storing said reference value associated with said predetermined encountering velocity value, includes storing a reference value which is also associated with a predetermined flight angle and a predetermined one of said plurality of detonation angles;

detonating said projectile at said predetermined detonation angle and thereby producing a plurality of fragments moving at a mean radial fragment velocity relative to ground; and said detonation angle obeying the relationship $$tg\ ZW = \frac{\sqrt{VR^2 - (VZ \sin FW)^2}}{VG + VZ \cos FW}$$

wherein:

ZW is the detonation angle,

VR is the mean radial fragment velocity of the fragments relative to ground,

VZ is the predetermined target velocity relative to ground,

FW is the flight angle formed between at least the section of the target flight trajectory and its associated plane, and VG is the predetermined projectile velocity relative to ground.

12. A method of detonating a projectile in the proximity of a target, comprising the steps of:

determining a target flight trajectory of a target;

firing a projectile towards said target along a predetermined projectile flight trajectory under control of a firing control system;

determining, in said projectile and during movement of said projectile along said predetermined projectile flight trajectory, a plurality of encountering velocity values of the projectile relative to the target;

upon firing of said projectile, storing therein a reference value associated with a predetemined encountering velocity value of the projectile relative to the target;

converting said plurality of encountering velocity values into a plurality of actual values associated with respective ones of said plurality of encountering velocity values;

comparing said actual values associated with respective ones of said plurality of encountering velocity values, with said stored reference value associated with said predetermined encountering velocity value;

detonating and thereby fragmenting said projectile at a predetermined result of said comparison of said actual values which are associated with respective ones of said plurality of encountering velocity values, with said stored reference value which is associated with said predetermined encountering velocity value;

during said steps of determining said plurality of encountering velocity values and converting the plurality of the thus determined encountering velocity values into said associated actual values, using a Doppler sensor operating at a predetermined frequency, dividing said predetermined frequency by a predetermined division factor, determining the target associated Doppler frequency, and determining the actual values in a form of f0/fDK, wherein c is the velocity of light, f0 the predetermined operation frequency of the Doppler sensor, and K the predetermined division factor;

during said step of storing said reference value associated with said predetermined encountering velocity value, storing the reference value in a form of f0/fD0K, wherein c is the velocity of light, fD0 a predetermined Doppler frequency and K said predetermined division factor; and said step of detonating and thereby fragmenting said projectile includes detonating and thereby fragmenting said projectile whenever said actual value associated with a respective one of said plurality of determined encountering velocity values selectively is either (i) substantially equal to or (ii) smaller than said stored reference value associated with said predetermined encountering velocity value.

13. The method as defined in claim 12, further including the step of:

activating said Doppler sensor after a preset time interval following the step of firing said projectile.

14. The method as defined in claim 12, further including the step of:

self-destructing said projectile whenever said predetermined result of said comparison has not been obtained within a predetermined time duration.

* * * * *